US008439288B2

(12) United States Patent
Nickel

(10) Patent No.: US 8,439,288 B2
(45) Date of Patent: May 14, 2013

(54) FEED DEVICE WITH TWO ROTARY VALVES WHICH ARE VARIABLE INDEPENDENTLY OF EACH OTHER

(75) Inventor: Alex Nickel, Siegburg (DE)

(73) Assignee: KHD Humboldt Wedag GmbH, Cologne (DE)

( * ) Notice: Subject to any disclaimer, the term of this patent is extended or adjusted under 35 U.S.C. 154(b) by 166 days.

(21) Appl. No.: 13/000,944

(22) PCT Filed: Jun. 30, 2009

(86) PCT No.: PCT/EP2009/058211

§ 371 (c)(1),
(2), (4) Date: Dec. 22, 2010

(87) PCT Pub. No.: WO2010/003850

PCT Pub. Date: Jan. 14, 2010

(65) Prior Publication Data

US 2011/0114772 A1 May 19, 2011

(30) Foreign Application Priority Data

Jul. 9, 2008 (DE) ..... 20 2008 009234 U

(51) Int. Cl.
*B02C 23/02* (2006.01)

(52) U.S. Cl.
USPC ..... 241/222; 241/224

(58) Field of Classification Search ..... 241/222, 241/224
See application file for complete search history.

(56) References Cited

U.S. PATENT DOCUMENTS

| | | | | |
|---|---|---|---|---|
| 3,386,670 | A * | 6/1968 | Heger | 241/74 |
| 3,774,857 | A * | 11/1973 | Decker et al. | 241/209 |
| 5,048,763 | A * | 9/1991 | Szazdi et al. | 241/24.1 |
| 5,076,504 | A * | 12/1991 | Young | 241/92 |
| 5,096,131 | A * | 3/1992 | Patzelt et al. | 241/224 |
| 5,417,374 | A * | 5/1995 | Kranz et al. | 241/18 |
| 5,876,648 | A | 3/1999 | Strasser et al. | |
| 7,980,527 | B2 * | 7/2011 | Gronvall | 248/500 |

FOREIGN PATENT DOCUMENTS

| | | |
|---|---|---|
| DE | 34 38 310 | 4/1986 |
| DE | 37 42 083 | 6/1989 |
| DE | 40 06 971 | 9/1991 |
| DE | 42 26 182 | 2/1994 |
| DE | 43 14 413 | 11/1994 |
| DE | 196 32 976 | 2/1998 |

* cited by examiner

*Primary Examiner* — Faye Francis
(74) *Attorney, Agent, or Firm* — Greer, Burns & Crain Ltd.

(57) ABSTRACT

A feed device for a high-pressure roller press for the high-pressure comminution of material to be ground, the feed device feeding the material to be ground in a controlled manner into the roller nip between two rollers of the high-pressure roller press. The feed device has at least two rotary valves, the position of which is variable independently of each other. In a refinement of the invention, the feed device also has a shaft which is variable in height above the roller nip. By means of the rotary valves which are variable independently of each other and by means of the height-variable shaft, the feeding behavior of the feed device can be varied during the starting of the high-pressure roller press and during the operation of the high-pressure roller press in order thereby to prevent the high-pressure roller press from vibrating and to ensure optimum operation of the high-pressure roller press.

20 Claims, 5 Drawing Sheets

FEED DEVICE WITH TWO ROTARY VALVES WHICH ARE VARIABLE INDEPENDENTLY OF EACH OTHER

BACKGROUND OF THE INVENTION

The invention relates to a feed device for a high-pressure roller press for the high-pressure comminution of grinding stock, said feed device delivering the grinding stock in a controlled manner into the roller nip between two rollers of the high-pressure roller press.

For the comminution of brittle grinding stock, Schönert in 1977 proposed in German Auslegeschrift DE 27 08 053 not to comminute the grinding stock in traditional fashion, but firstly, through the application of high pressure in a roller nip, to press the grinding stock into flakes, whereupon the structure of the grinding stock ruptures. In a further step, the flakes emerging from the roller nip can be broken down into their individual component parts using comparatively little energy. The high-pressure pressing in the roller nip and the subsequent disagglomeration of the pressed flakes demands less energy for the comminution per unit of mass of grinding stock than does a conventional grinding process. Through this type of comminution, high grinding finenesses are attainable, for which purpose a circulation of the grinding stock is necessary. Since the roller nip, however, is wider than the greatest extent of the comminuted grinding stock, it is important to charge the roller nip such that, at the same time, a specific quantity of the grinding stock passes through the roller nip. If the roller nip is charged with too small a quantity per unit of time, then in the extreme case the grinding stock is no longer comminuted at all or the high-pressure roller press acts similarly to a crusher. If, on the other hand, too large a quantity is poured onto the roller nip, it can happen that the high-pressure roller press is overloaded and starts to vibrate. Upon the vibration, the roller nip gets larger and smaller in terms of resonance frequency and also the circulation speed varies with resonance frequency, since, in the event of an overload, the rollers of the high-pressure roller press are repeatedly braked by the excess of grinding stock and re-accelerated by the drive motors. In the case of high-pressure comminution in the roller nip, care must therefore be taken to ensure that the roller nip is supplied with grinding stock in suitable measure. The actual feed quantity is heavily dependent, however, on the nature of the grinding stock. The noteworthy parameters to which regard should be paid are the grain size distribution, the mean grain size and the evenness of the available stream of grinding stock onto the roller nip. For the delivery onto the roller nip, the grinding stock or 'feed material' must be fed evenly into the roller nip from above.

The type of material charging has a significant influence on the smooth running of the high-pressure roller press. In order to improve the feed conditions and ensure an even distribution of the drive power to the drive motors of the high-pressure roller press, the working of a feed device above the roller nip is therefore being steadily improved.

German Offenlegungsschrift DE 34 38 310 A1 discloses a device for evening out the delivery of feed material via a feed gate into a comminuting machine, wherein the feed material is repeatedly redirected.

In German Offenlegungsschrift DE 40 06 971 A1, a feed device for filling granular solids into a comminuting machine is disclosed, wherein a pipe resonator is disposed between a hopper and the comminuting machine.

Finally, German Offenlegungsschrift DE 196 32 976 A1 and corresponding U.S. Pat. No. 5,876,648 discloses a feed device which divides the feed material into two fractions by means of a screen and delivers the fractions from different sides onto the roller nip of a high-pressure roller press.

SUMMARY OF THE INVENTION

The object of the invention is to improve the function of the feed device in terms of the feed characteristics of the high-pressure roller press in its entirety and in terms of an even distribution of the drive power to different drive motors of the high-pressure roller press.

The object of the invention is achieved by virtue of the fact that the feed device has at least two rotary valves, the position of which can be varied independently of one another.

Through the presence of at least two rotary valves, the feed device according to the invention allows adaptation to the varying requirements associated with the changing material properties of the feed material. It is thus possible to open and close the two rotary valves in symmetry in order thus to deliver a specific average total quantity per unit of time to the high-pressure roller press. Apart from this pure metering function, as a result of uniform opening around the center point of the feed device centrally above the roller nip of the high-pressure roller press, it is also possible to set the two rotary valves such that the center of opening between the at least two rotary valves is not arranged over the center of the roller nip, but is laterally offset thereto. It is hereby possible to vary not only the feed quantity, but also the exact delivery location. Specifically when the high-pressure roller press is started, this adjustment facility makes it easier to quickly reach the optimal operating state of the high-pressure roller press.

In one embodiment of the invention it is provided that the rotary valves are disposed on a shaft which is variable in height above the roller nip. The height-variability of the shaft, and hence also of the rotary valves, allows the bulk material cone leaving the feed device to be altered, within the limits of the natural bulk material cone that is predefined by the material properties of the feed material, on the one hand, by the mechanical movement of the bulk material cone from below and, on the other hand, by the rotating rollers of the high-pressure roller press. This variation facility, too, offers operating staff the opportunity to configure the optimal bulk material cone over the roller nip, so that a low-vibration operation with minimum possible energy consumption is possible.

In order to protect the shaft from excessive abrasion by ores or by non-comminuted cement clinker, in a further embodiment of the invention it is provided that the shaft is provided with an exchangeable inner lining as an abrasion protection. If the abrasion protection is eroded during operation, then the inner lining, which the lining and shaft lie one inside the other like two stacked together shafts, can be exchanged with comparatively little effort, and thus the shaft, which in addition to its shaft function must also deflect mechanical forces, can be protected from destruction.

According to the invention, the rotary valves are adjustable by means of a hydraulic system. Although it is also possible to choose another type of drive, hydraulic operation has proved advantageous because it is robust enough to withstand the rough conditions associated with the grinding of brittle material. It is here provided that the hydraulic system acts on one side upon the rotary valve, and with the other side of the telescopic hydraulic system upon the shaft, which shaft can be varied in height above the roller nip. Insofar as the supply lines for the hydraulic systems are long enough and flexible, it is possible to raise and lower the shaft which is variable in height above the roller nip, in which case the hydraulic systems for the opening and closure of the rotary valves travel along with the shaft.

According to the invention, the position of the shaft which is variable in height above the roller nip is adjusted via a further hydraulic system, in which case it has proved advantageous if at least one hydraulic system is respectively disposed on two opposite sides of the shaft. These hydraulic systems raise the entire shaft, on which there is arranged a funnel-shaped plate and into which conveyor belts or other conveying devices deposit the feed material. When the shaft which is variable in height above the roller nip is raised or relowered, the entire hopper, together with its content, the feed material present in the hopper, is thus raised or relowered. In addition to the lowering and raising of the whole of the hopper arrangement, it is also possible for the shaft to be telescopically configured and for the hopper not to travel along with the shaft. In this case, the telescopic shaft collapses and extends according to the direction in which the shaft is moving, but it has proved more advantageous if specifically this telescopic arrangement of the shaft is dispensed with. Abrasive feed material can too easily gather in the telescopic attachment and disturb the telescopic function.

In one embodiment of the invention, it is provided that the shaft which is variable in height above the roller nip is adjustable in height above the roller nip via a hydraulic system, wherein the hydraulic system, on the one hand, acts upon a rack system which receives the shaft which is variable in height above the roller nip, and, on the other hand, acts upon the shaft which is variable in height above the roller nip.

The hydraulic systems for raising and lowering the systems act, on the one hand, as closely as possible upon the shaft itself and, on the other hand, as closely as possible upon a vertical strut of a rack system within which the shaft moves up and down, in order to avoid buckling of the shaft in the rack system under mechanical load. According to the existing interspace between the shaft and the rack system, the hydraulic system is thus aligned almost vertically or at a slight vertical angle.

Since the shaft is raised and relowered within the rack system by the hydraulic system, it is advantageous if the shaft is supported by a linear bearing within the rack system and, when raised and relowered, slides up and down within the linear bearing. The linear bearing consists in its simplest form of a U-profile, which is disposed on the shaft with its opening facing outward and in which a horizontal stay reaching from the rack system to the linear bearing engages; the stay is here fixedly connected to the rack system. The converse arrangement, too, is possible, in which the stay is fastened to the shaft and engages in a linear bearing on the rack system.

BRIEF DESCRIPTION OF THE DRAWINGS

The invention is explained in greater detail with reference to the following figures, wherein.

DETAILED DESCRIPTION OF THE PREFERRED EMBODIMENTS

Figure 1:
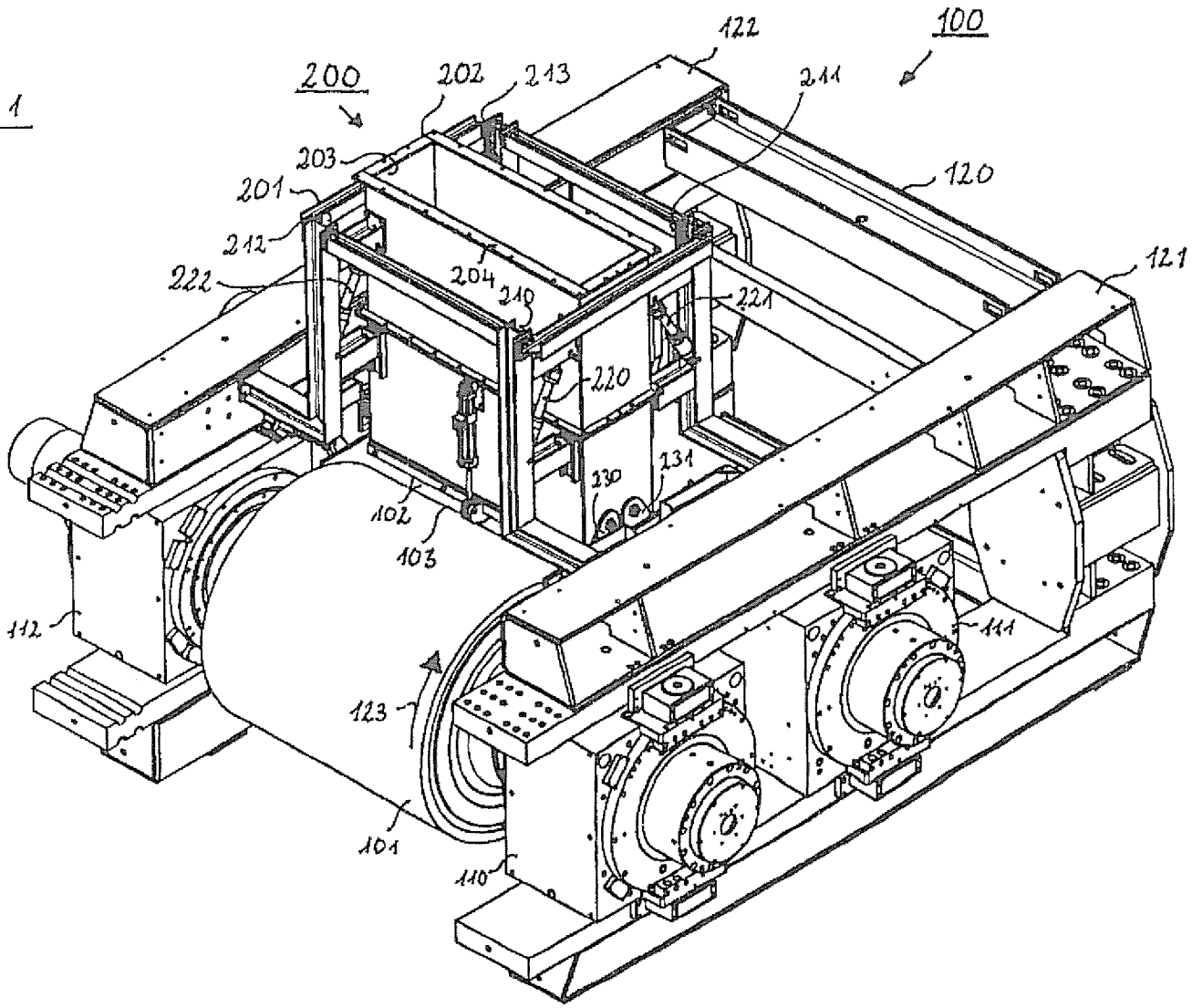
FIG. 1 shows a high-pressure roller press with mounted feed device according to the present invention.

In FIG. 1 there is configured a high-pressure roller press 100, on which a feed device 200 according to the present invention is mounted. The high-pressure roller press 100 has two rollers 101 and 102, in this view the roller 102 being for the most part concealed, and the two rollers 101 and 102 form a roller nip 103 through which the feed material 104 (not represented here) passes, wherein the feed material 104, during passage through the roller nip 103, is comminuted by the high pressure prevailing therein. In order to be able to absorb the high forces which arise in the course of the high-pressure comminution, the rollers 101 and 102 are mounted in large-sized bearings 110, 111, 112 and in the bearing 113 (visible in FIG. 5) which in FIG. 1 is concealed by the drawing view, and the bearings 110, 111, 112 and 113 are for their part accommodated in a machine frame 120, which slidingly fixes the four bearings 110, 111, 112 and 113. Slidingly fixes means that the two rollers 101 and 102 are horizontally movable in order to be able to evade passages of non-comminutable material through the roller nip 103. For the sliding mounting, depending on the embodiment of the high-pressure roller press 100, either both rollers 101 and 102 are realized as loose rollers or one of the rollers 101 and 102 is a fixed roller and the respective other roller is a loose roller, the loose roller being arranged such that it is movable within the machine frame 120 relative to the fixed roller. For the high-pressure comminution, it is provided that the rollers 101 and 102 rotate in opposite directions, in this example the front roller 101 having the rotational direction indicated by the arrow 123 and the second roller 102, corresponding thereto, having an opposite rotational direction. In order that the rollers 101 and 102 have no slip and do not grind together and thus rapidly suffer heavy wear, but instead only press, it is provided that the rollers 101 and 102 rotate as far as possible at the same, but oppositely directed rotation speed without relative slip.

The feed device 200 is fixed to the upper crossbeams 121 and 122 with the aid of a rack system 201, the rack system 201 forming a cage containing a shaft 202 which is variable in height above the roller nip 103. The shaft 202 is here mounted in linear bearings 210, 211, 212 and 213 and is connected to the rack system 201 by hydraulic rams 220, 221, 222 and a hydraulic ram 223 which in this view is concealed. In order to raise the shaft 202, the hydraulic rams 220, 221, 222 and 223 extend telescopically and thus lift the shaft 202 clear of the rack system 201. In one embodiment of the invention, it is provided that on top of the shaft 202 is arranged a larger hopper, into which conveyor belts or other conveyors pour feed material 104, which feed material is delivered by the feed device 200 evenly onto the roller nip 103. In addition to varying the height of the shaft 202 above the roller nip 103, it is also possible to vary the opening of the shaft 202 down to the roller nip 103 by means of two rotary valves 230 and 231.

Figure 2:
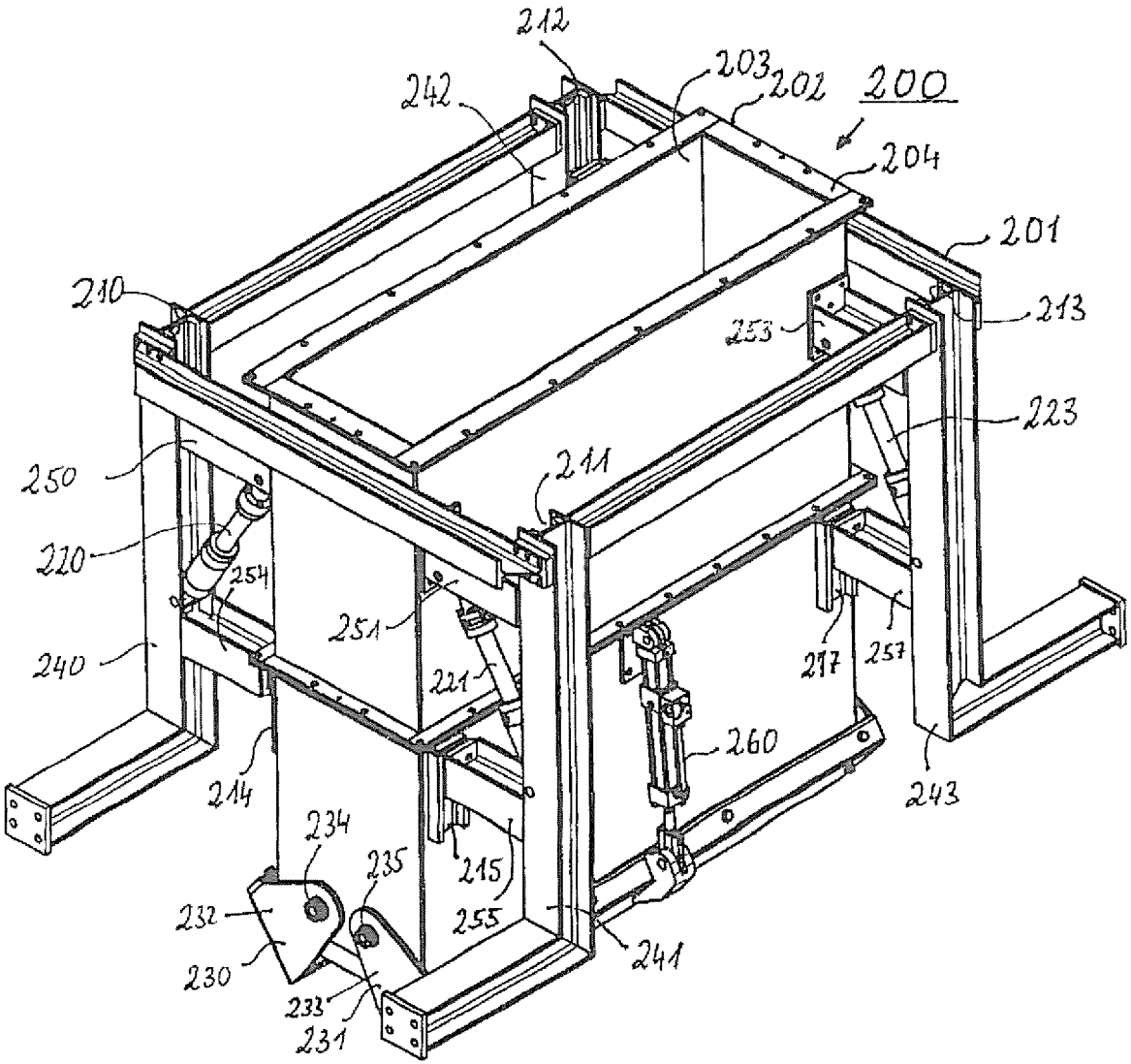
FIG. 2 shows the feed device according to the invention.

The feed device 200 is represented in FIG. 2 as a single structure and is illustrated in greater detail. The rack system 201, within which is accommodated a shaft 202 which is variable in height above the roller nip 103, is clearly apparent, the shaft 202 being connected to the rack system 201 by hydraulic rams 220, 221, 222 and 223. In order to avoid buckling of the shaft 202 under the load of a hopper (not illustrated) mounted on the shaft 202, the various hydraulic rams 220, 221, 222 and 223 are each supported on a vertical strut 240, 241, 242 and 243 and act upon the shaft 202 in its immediate vicinity. The hereby diagonal arrangement of the hydraulic rams 240, 241, 242 and 243 can be clearly seen in FIG. 2. In order to stabilize the vertical path of the shaft 202, the shaft 202 is mounted in linear bearings 210, 211, 212, 213 with four horizontal stays 250, 251, 252 and 253, which are fastened to the shaft 202, engaging respectively in one of the linear bearings 210, 211, 212, 213. Beneath the mounting in four linear bearings 210, 211, 212, 213, the shaft 202 is mounted with further stays 254, 255, 257 and with the stay 256 which in this drawing is concealed, in lower linear bearings 214, 215, 217, and in the linear bearing 216 which in this drawing is concealed, whereof only the linear bearings 215 and 217 which are facing forward to the right are visible in FIG. 2. Conversely to the above-described combination of linear bearings 210, 211, 212, 213 and stays 250, 251, 252 and 253, the corresponding lower stays 254, 255, 257 and the non-visible stay 256 are fastened to the shaft 202 and the lower linear bearings 214, 215, 217 and 218 are supported on the vertical struts 240, 241, 242 and 243.

At the lower opening of the shaft 202 are located the two rotary valves 230 and 231, which are opened and closed independently of each other by hydraulic rams 260 escorting the shaft 202, and by the hydraulic ram 261 which corresponds thereto and which in this view is concealed. For this, the hydraulic rams 260 and 261 act with one end upon the shaft 202 and with respectively another end of the hydraulic ram 260 and 261 upon the rotary valves 230 and 231. The fact that the two hydraulic rams 260 and 261 can be extended and retracted independently of each other allows the position of the two rotary valves 230 and 231 to be adjusted such that the center of the opening between the two rotary valves 230 and 231 is located directly above the roller nip 103 in the state installed in a high-pressure roller press 100. This adjustability leaves enough clearance for a high-pressure roller press 100 equipped with this feed device 200 to be operated without vibrations in an optimal operating state.

In order to avoid excessively rapid wearing by abrasion, it is envisaged to provide the shaft 202 with an inner lining 203 which is inserted in the shaft 202 and fastened to the flange 204. A respectively corresponding abrasion protection 232 and 233 is present on the inner sides of the rotary valves 230 and 231 in order to protect the rotary valves 230 and 231, exposed to considerable abrasive forces, from premature wearing.

Figure 3:
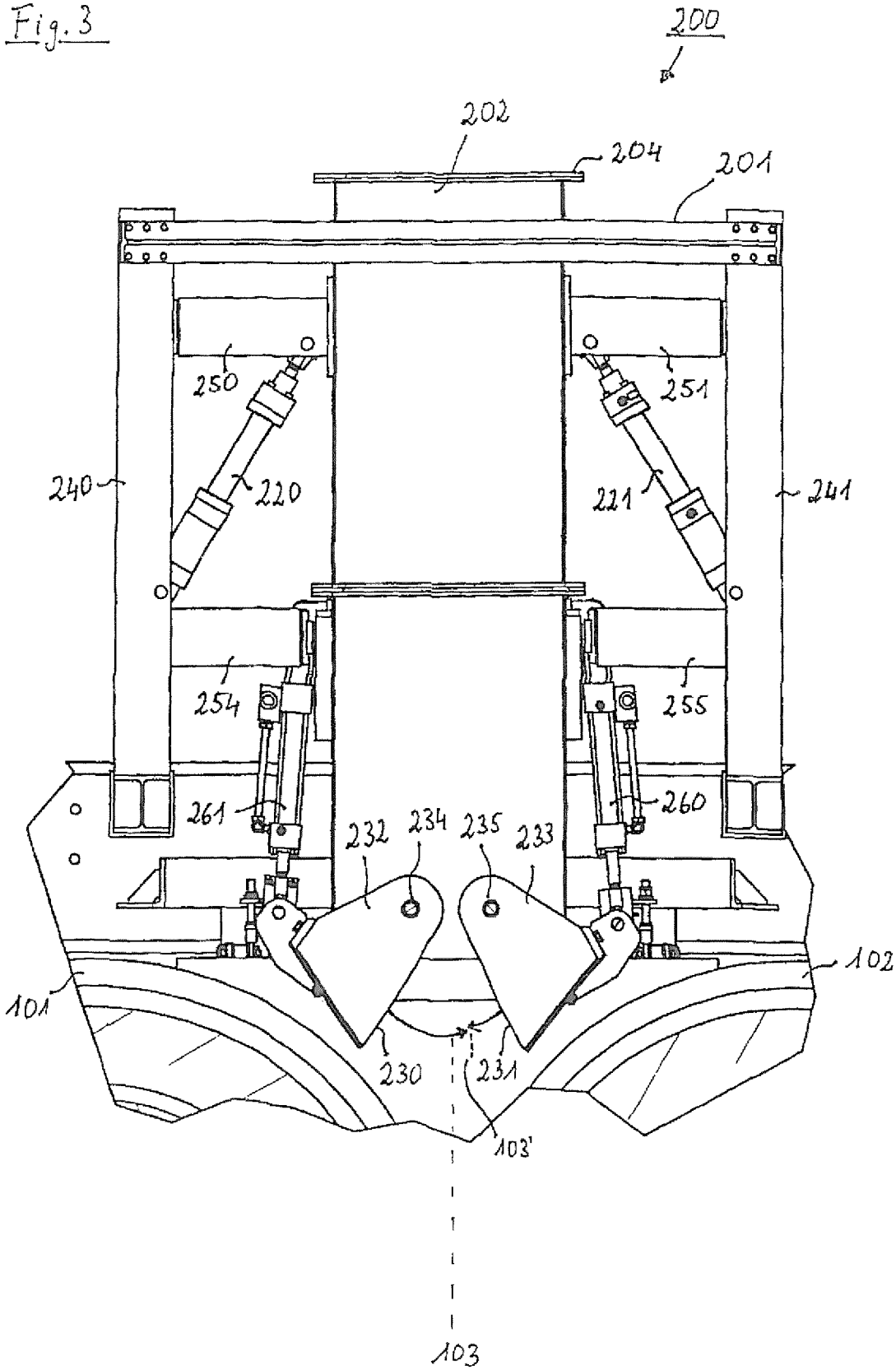
FIG. 3 shows a side view of the feed device.

In FIG. 3, the shaft 202 inserted in the rack system 201 is represented in a side view, from which the working of the hydraulic rams 220, 221 and the concealed hydraulic rams 222 and 223 for the raising and lowering of the entire shaft 202, on the one hand, and the working of the hydraulic rams 260 and 261 for the opening and closing of the rotary valves 230 and 231, on the other hand, is more clearly apparent. By virtue of the side view, it can clearly be seen in FIG. 3 that the center of the opening between the two rotary valves 230 and 231, depending on the position of the rotary valves 230 and 231, can also be located alongside the center (103') above the roller nip 103. It is here provided that the rotary valves 230, 231, when symmetrically positioned, deliver the grinding stock 104 centrally above the roller nip 103 onto the high-pressure roller press 100 and, when non-symmetrically positioned, deliver the grinding stock 104 outside the center (103') above the roller nip 103 onto the high-pressure roller press 100.

Figure 4:
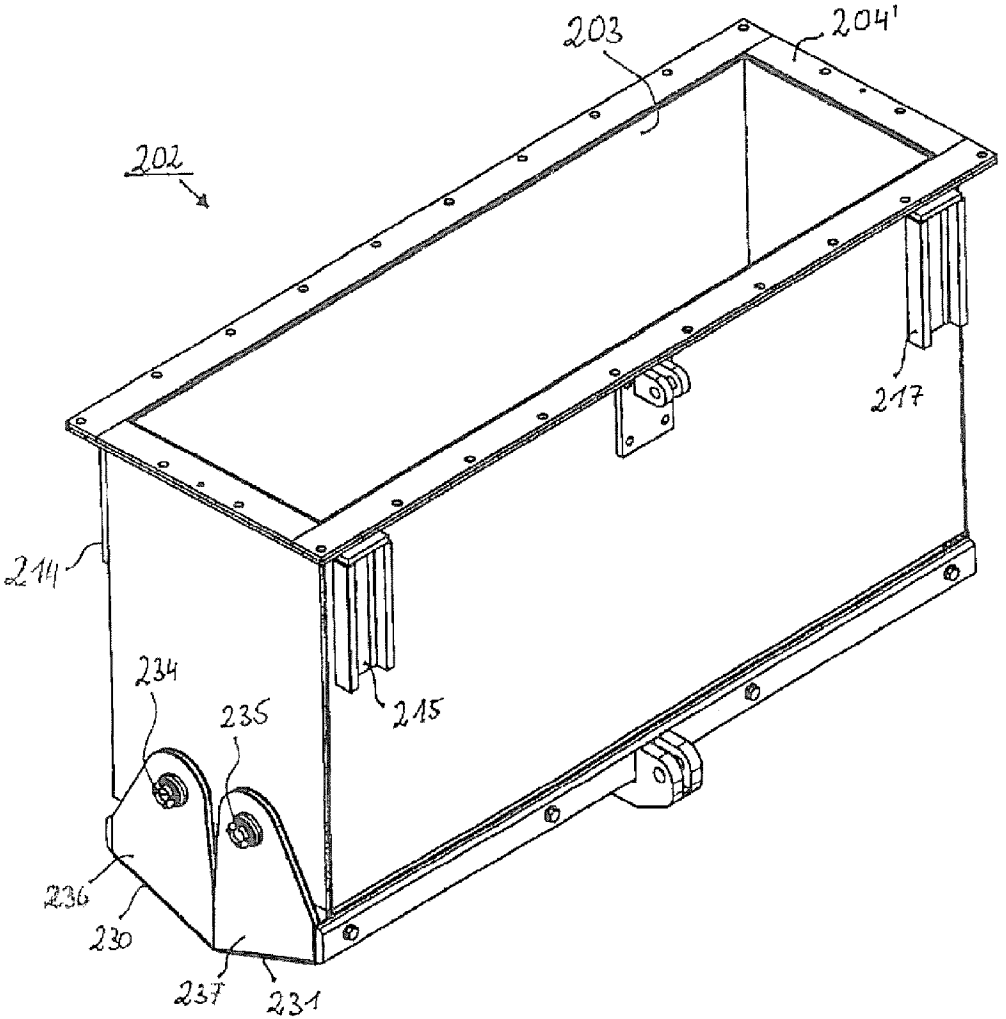
FIG. 4 shows a lower part of the shaft of the feed device as a detail.

In FIG. 4, a lower part of the shaft 202 is represented, which here is illustrated without hydraulic rams 220, 221, 222 and 223 and without hydraulic rams 260 and 261. The mounting of the rotary valves 230 and 231 in the bearings 234 and 235 and the configuration of the end faces 236 and 237 of the two rotary valves 230 and 231 serves to ensure that the rotary valves 230 and 231, given a position in which the opening between the two rotary valves 230 and 231 is located outside the center above the roller nip 103, do not block each other.

Figure 5:
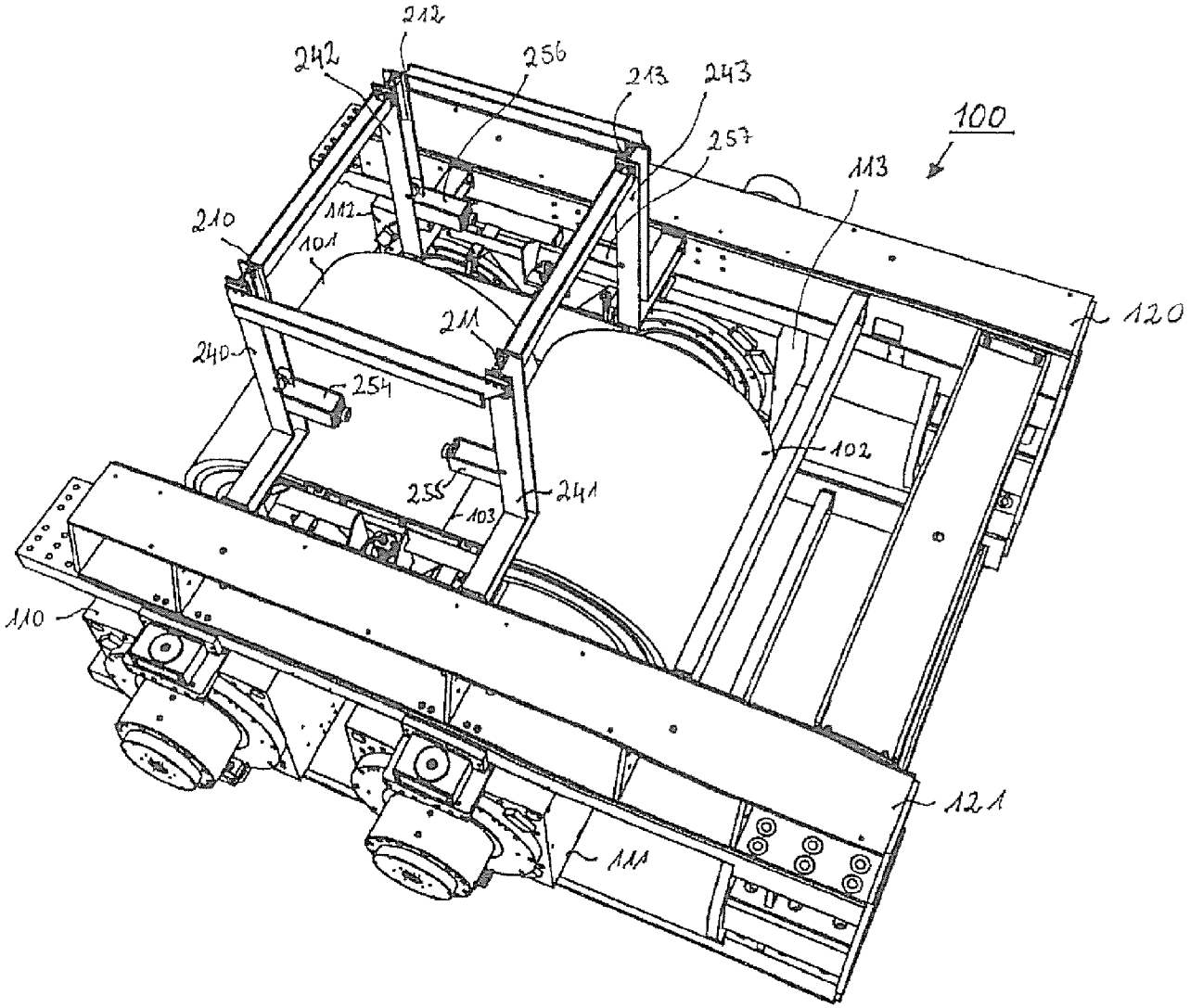
FIG. 5 shows the high-pressure roller press according to FIG. 1, with mounted rack system of the feed device.

The rack system 201 can be separated from the shaft 202 by detachment of the hydraulic rams 220, 221, 222 and 223 from the rack system 201. In FIG. 5, the rack system 201 which has thus been separated is represented without moving elements and in FIG. 5 is portrayed as fitted into the machine frame 120 of a high-pressure roller press. Following fitting of the rack system 201, which is aligned exactly centrally over the roller nip 103 of the high-pressure roller press, the shaft 202 is hung in the rack system 201, in which the hydraulic rams 220, 221, 222 and 223 connect the shaft 202 to the rack system 201 and support said shaft.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

REFERENCE SYMBOL LIST

100 high-pressure roller press
101 roller
102 roller
103 roller nip
104 feed material
110 bearing
111 bearing
112 bearing
113 bearing
120 machine frame
121 crossbeam
122 crossbeam
123 rotational direction
200 feed device
201 rack system
202 shaft
261 hydraulic ram
203 inner lining
204 flange
204' flange
210 linear bearing
211 linear bearing
212 linear bearing
213 linear bearing
214 linear bearing
215 linear bearing
216 linear bearing
217 linear bearing
220 hydraulic ram
221 hydraulic ram
222 hydraulic ram
223 hydraulic ram
230 rotary valve
231 rotary valve
232 abrasion protection
233 abrasion protection
234 bearing
235 bearing
236 end face
237 end face
240 strut
241 strut
242 strut
243 strut
250 stay
251 stay
252 stay
253 stay
254 stay

255 stay
256 stay
257 stay
260 hydraulic ram

The invention claimed is:

1. A feed device for a high-pressure roller press for the high-pressure comminution of grinding stock, said feed device delivering the grinding stock in a controlled manner into a roller nip forming a centerline between two rollers of the high-pressure roller press, each roller rotating about an axis of rotation, the feed device comprising:

at least two rotary valves, the positions of which can be varied independently of one another, the rotary valves being disposed on a vertical feed shaft for the grinding stock having a rectangular cross section, the shaft having two side walls parallel to each other and parallel to, but spaced inwardly, toward the centerline, relative to the axes of rotation of the rollers, the shaft further having two end walls connecting the two side walls and being arranged perpendicular to the axes of rotation of the rollers, the rotary valves being pivotally attached to the end walls at positions that are spaced inwardly of an edge of said end walls and spaced above a bottom of said end walls.

2. The feed device as claimed in claim 1, wherein the rotary valves, when symmetrically positioned, deliver the grinding stock centrally above the roller nip onto the high-pressure roller press and, when non-symmetrically positioned, deliver the grinding stock outside the center above the roller nip onto the high-pressure roller press.

3. The feed device as claimed in claim 1, wherein the shaft is variable in height above the roller nip.

4. The feed device as claimed in claim 3, wherein each of the rotary valves are separately adjustable by means of a separate hydraulic system, wherein each hydraulic system acts upon a respective rotary valve and upon the shaft, wherein each hydraulic system moves along with the shaft.

5. The feed device as claimed in claim 3, wherein the shaft is adjustable in height by means of a hydraulic system, wherein the hydraulic system, on the one hand, acts upon a rack system which receives the shaft, and, on the other hand, acts upon the shaft.

6. The feed device as claimed in claim 3, wherein the shaft is mounted in at least one linear bearing.

7. The feed device as claimed in claim 1, wherein the shaft is provided with an exchangeable inner lining as an abrasion protection.

8. A feed device for a high-pressure roller press for the high-pressure comminution of grinding stock, said feed device delivering the grinding stock in a controlled manner into a roller nip between two rollers of the high-pressure roller press, the feed device comprising:

at least two rotary valves, the positions of which can be varied independently of one another, the rotary valves being pivotally mounted on a feed shaft for the grinding stock such that the valves comprise two movable walls that can be independently pivoted into positions ranging between a position to completely close off a bottom opening of the shaft to a position to completely open the bottom opening of the shaft without internal interference.

9. The feed device as claimed in claim 8, wherein the rotary valves, when symmetrically positioned, deliver the grinding stock centrally above the roller nip onto the high-pressure roller press and, when non-symmetrically positioned, deliver the grinding stock outside the center above the roller nip onto the high-pressure roller press.

10. The feed device as claimed in claim 8, wherein the shaft is variable in height above the roller nip.

11. The feed device as claimed in claim 8, wherein the shaft is provided with an exchangeable inner lining as an abrasion protection.

12. The feed device as claimed in claim 10, wherein each of the rotary valves are separately adjustable by means of a separate hydraulic system, wherein each hydraulic system acts upon a respective rotary valve and upon the shaft, wherein each hydraulic system moves along with the shaft.

13. The feed device as claimed in claim 8, wherein the shaft is adjustable in height by means of a hydraulic system, wherein the hydraulic system, on the one hand, acts upon a rack system which receives the shaft, and, on the other hand, acts upon the shaft.

14. The feed device as claimed in claim 10, wherein the shaft is mounted in at least one linear bearing.

15. A feed device for a high-pressure roller press for the high-pressure comminution of grinding stock, said feed device delivering the grinding stock in a controlled manner into a roller nip between two rollers of the high-pressure roller press, the feed device comprising:

at least two rotary valves, the positions of which can be varied independently of one another, the rotary valves being pivotally mounted on a feed shaft for said grinding stock, the rotary valves being separately adjustable a separate adjustment mechanism extending between an outside of said shaft and each of said valves.

16. The feed device as claimed in claim 15, wherein the rotary valves, when symmetrically positioned, deliver the grinding stock centrally above the roller nip onto the high-pressure roller press and, when non-symmetrically positioned, deliver the grinding stock outside the center above the roller nip onto the high-pressure roller press.

17. The feed device as claimed in claim 15, wherein the shaft is variable in height above the roller nip.

18. The feed device as claimed in claim 15, wherein the shaft is provided with an exchangeable inner lining as an abrasion protection.

19. The feed device as claimed in claim 17, wherein the separate adjustment mechanisms each comprise a separate hydraulic system, wherein each hydraulic system moves along with the shaft.

20. The feed device as claimed in claim 15, wherein the shaft is adjustable in height by means of a hydraulic system, wherein the hydraulic system, on the one hand, acts upon a rack system which receives the shaft, and, on the other hand, acts upon the shaft.

* * * * *